United States Patent [19]

Braly

[11] Patent Number: 4,736,093

[45] Date of Patent: Apr. 5, 1988

[54] CALCULATOR FOR DETERMINING FREQUENCY MATCHED SET OF GOLF CLUBS

[75] Inventor: Joseph M. Braly, Kennett Square, Pa.

[73] Assignee: Brunswick Corporation, Skokie, Ill.

[21] Appl. No.: 861,593

[22] Filed: May 9, 1986

[51] Int. Cl.[4] ..... G06C 3/00

[52] U.S. Cl. ..... 235/88 G; 235/78 G

[58] Field of Search ..... 235/88 R, 88 G, 78 G, 235/70 A; 273/77 A

[56] References Cited

U.S. PATENT DOCUMENTS

| | | | |
|---|---|---|---|
| 3,363,836 | 1/1968 | Lee | 235/78 G |
| 3,757,092 | 9/1973 | Miller | 235/88 R X |
| 4,070,022 | 1/1978 | Braly | 273/77 A |
| 4,122,593 | 10/1978 | Braly | 273/77 A X |
| 4,137,448 | 1/1979 | Smith | 235/78 G |

*Primary Examiner*—Benjamin R. Fuller

*Attorney, Agent, or Firm*—Art Greif

[57] ABSTRACT

A special purpose calculator for determining the optimum degree of flexibility for a matched set of golf clubs, tailored to the driving capability of the individual golfer. The calculator first correlates the effective driving capability of the individual to an empirically determined optimum flexibility index, which index is based on a standard club length, hosel length, tip insertion depth, and swing weight of the golf club. The calculator next compensates for desired differences, in for example club length and swing weight, to determine a shaft with a compensated flexibility index which will provide the same "feel" as the standard club. The calculator can then also be used to determine the requisite head weights, both wood and iron, as a function of desired club length and swing weight so as to provide the proper flexibility for that individual. For optimum results, the flexibility index is determined by measuring the vibration frequency of the shaft.

10 Claims, 3 Drawing Sheets

CALCULATOR FOR DETERMINING FREQUENCY MATCHED SET OF GOLF CLUBS

TECHNICAL FIELD

This invention relates to a method for constructing a set of golf clubs tailored to the individual capability of the golfer, and more particularly relates to a special purpose slide rule for determining optimum shaft flexibility and head weights therefor, in a matched set of golf clubs, based on the driving capability of the individual and the golf club length and swing weight preferred by that individual.

BACKGROUND ART

High quality golf club sets are produced and marketed in what is termed "matched sets", each golf club being constructed such that the flexing characteristics of the club will provide the same degree of "feel" throughout the set. Although "feel" is somewhat subjective, it is generally well accepted that a golf club which provides proper "feel" will aid the golfer in achieving: (i) optimum club head velocity and club head position at the point of ball impact—providing better overall shots; and (ii) greater uniformity from shot to shot—both of which will contribute to lower total scores. U.S. Pat. No. 4,070,022, the disclosure of which is incorporated herein by reference, is directed to a method for accurately quantifying relative "feel", based on the frequency of vibration of a specific shaft. After the frequency determinations are made, shafts are selected from a plurality of selected shafts in which the frequencies fall on a predetermined gradient formed by a plot of shaft frequency and shaft length, in which shaft frequency increases as shaft length decreases. Subsequent mating of the shafts with weight-matched club heads produces a set of matched golf clubs.

U.S. Pat. No. 4,122,593, directed to a further advance, eliminates the need for classifying and storing large quantities of shafts in which the lengths and frequencies had been measured as set forth in the '022 patent. In the '593 patent, oversize blanks are utilized, one for each shaft length. The frequency of the blank is determined and a prescribed amount is removed to obtain the desired length. The amount of length removed and its location (i.e., whether from the tip or butt portion of the shaft) determines the frequency of the final shaft—enabling the manufacturer to directly produce a shaft with a desired frequency. Even with the ability to directly produce shafts with predetermined lengths and frequencies, the supply of shafts for a "matched set" required that the club manufacturer select (based on experience with other clubs) the frequency level, swing weight, and club weight which could form the basis of a "matched set" to be evaluated in a test program. Utilizing a series of charts and graphs which correlated head weights to frequency, an employee with long experience (as to the further effects of hosel length and tip insertion depths on frequency level) could then determine what shafts to utilize for the "matched set" to be supplied for the club manufacturer's evaluation.

DISCLOSURE OF INVENTION

A calculator has therefore been developed which enables one readily to determine the requisite shafts and corresponding head weights for a matched set of golf clubs, matched to provide an optimum degree of flexibility or stiffness, so as to provide optimum "feel". The calculator first computes a base flexibility index for the matched set of golf clubs, based on the driving capability of the individual for whom the set is intended. It thereafter compensates for differences in club length, hosel length, tip insertion depth, and swing weight of the golf club to the extent that the desired club length differs from the reference lengths, depth, and swing weight employed in determining the base flexibility index. Once such compensations are determined by the calculator, the club maker selects a set of shafts exhibiting the compensated flexibility index, and thereafter installs heads on each shaft intended to be part of the set, wherein the weight of the head is correlated with the desired length of each shaft in the set—the head weight being a value predetermined to provide the optimum flexibilty for the desired club swing weight. To provide superior accuracy and uniformity in shaft selection, the flexibility index is preferably determined by measuring the vibration frequency of the shaft, e.g., by the method described in the '022 patent wherein one end of the shaft is clamped, while the other, cantilevered end is flexed from its normal axis. Therafter, the flexing force is removed so as to set the cantilevered shaft into vibration—such vibrations being measured by a conventional frequency meter.

These and other advantages of the instant invention will become more apparent from the following detailed description when read in conjunction with the appended claims and the accompanying drawings in which:

MODES FOR CARRYING OUT THE INVENTION

Figure 1:
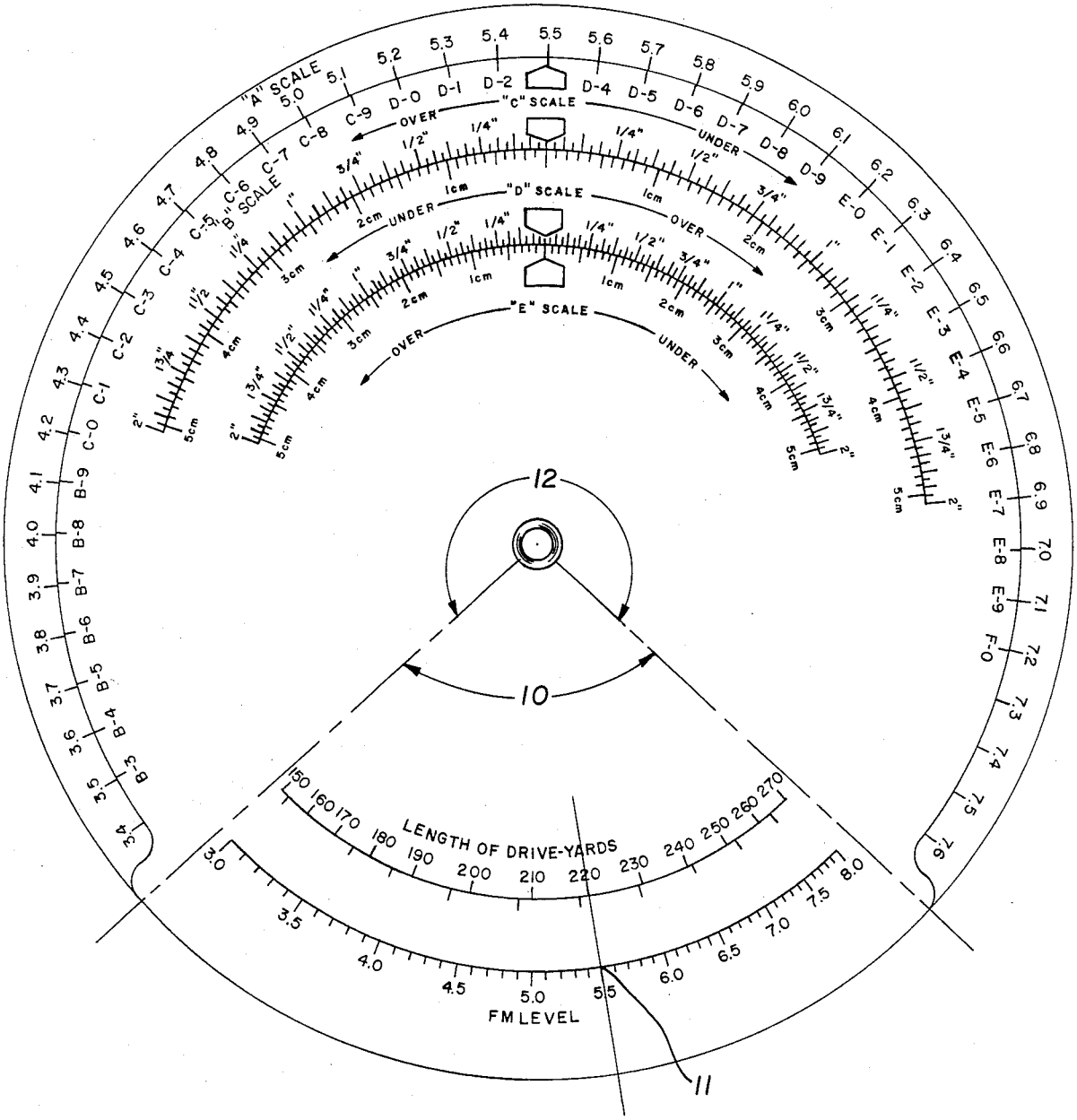
FIG. 1 shows a first face of a circular slide rule (a preferred embodiment of the the calculator of this invention), illustrating sectors thereof used to determine optimum flexibility and to compensate for swing weight and club length preferences of an individual golfer.

It will be apparent that the calculations contemplated herein may be carried out by a variety of calculators, whether digital or analog. One form of analog calculator is the slide rule, which itself can be embodied in a variety of forms, i.e., linear, cylindrical or spiral, and circular. The latter embodiment is particularly preferred, since for a given size it can offer greater accuracy than a linear rule, while avoiding the complicated construction problems associated with a cylindrical or spiral slide rule. Referring to FIG. 1, it is seen that in the preferred embodiment, the front face of the circular slide rule may be divided into different sectors performing different functions. The use of two different sectors is shown in FIG. 1. The lower sector, 10, is used to determine the optimum flexibility index, preferably determined by frequency measurement, as a function of the driving capability of the individual for whom the set is intended, such driving capability being measured, for example, by the average effective distance the individual can consistently drive a golf ball. Sector 10 is composed of an outer arcuate row, "A" scale, of flexibility indicia, comprising the range of flexibility levels exhibited by golf shafts to be supplied; and an inner arcuate row of indicia, "B" scale, comprising the range of driving capabilities of the individual golfers, such inner row being concentric with the outer row.

As an example, assume an individual has an average effective driving distance of 220 yards. Based on empirical studies, it was determined that a flexibility index of 5.5 (which corresponds to a frequency of 289.2 cpm, determined by the method of the '022 patent for a reference shaft having a D-3 swing weight, a 39 inch length for a No. 2 iron, a 2.5 inch hosel length, and 1.25 inch tip insertion depth) would be optimum, as shown at 11, for an individual golfer of this capability. If the golfer desired a set of golf clubs based on the standard or reference shaft, no further compensations would be required—which compensations are encompassed by Sector 12 of the front face. The golf club supplier would therefore refer to the reverse side of the calculator, FIG. 4, and rotate the iron and wood window pointers to the reference D-3 swing weight. Requisite head weights, in grams, would then be set forth in the two windows, 13 and 14 respectively, for the club lengths of the various woods and irons desired.

Figure 2:
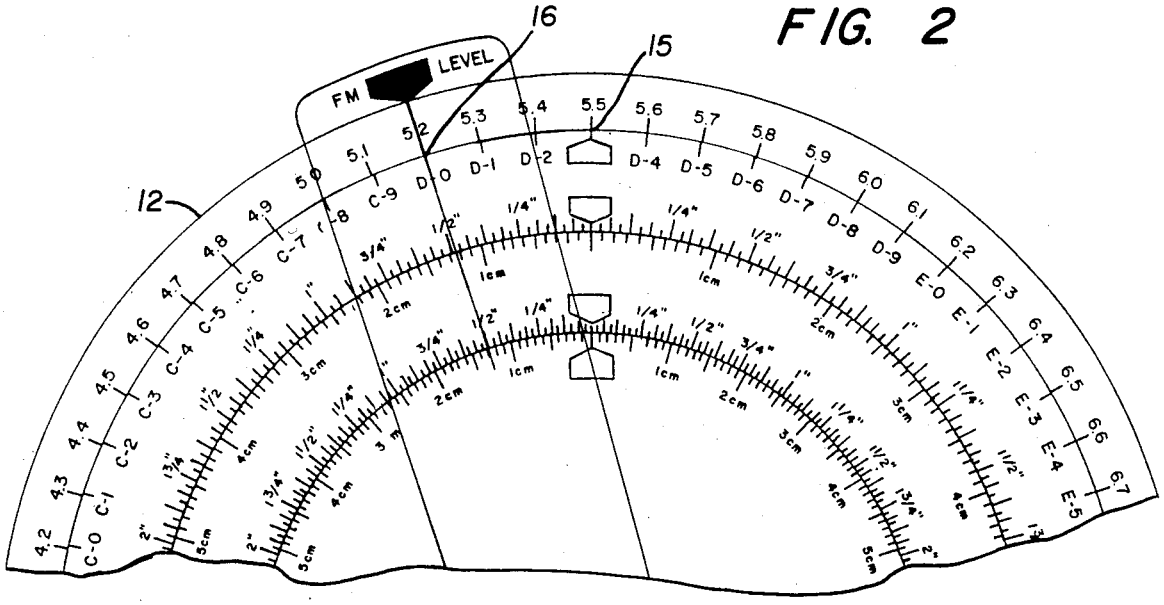
FIG. 2 shows the rotation of the inner concentric scale vs. that of the outer scale, of the circular slide rule, to compensate for desired variation from the reference swing weight.
Figure 3:
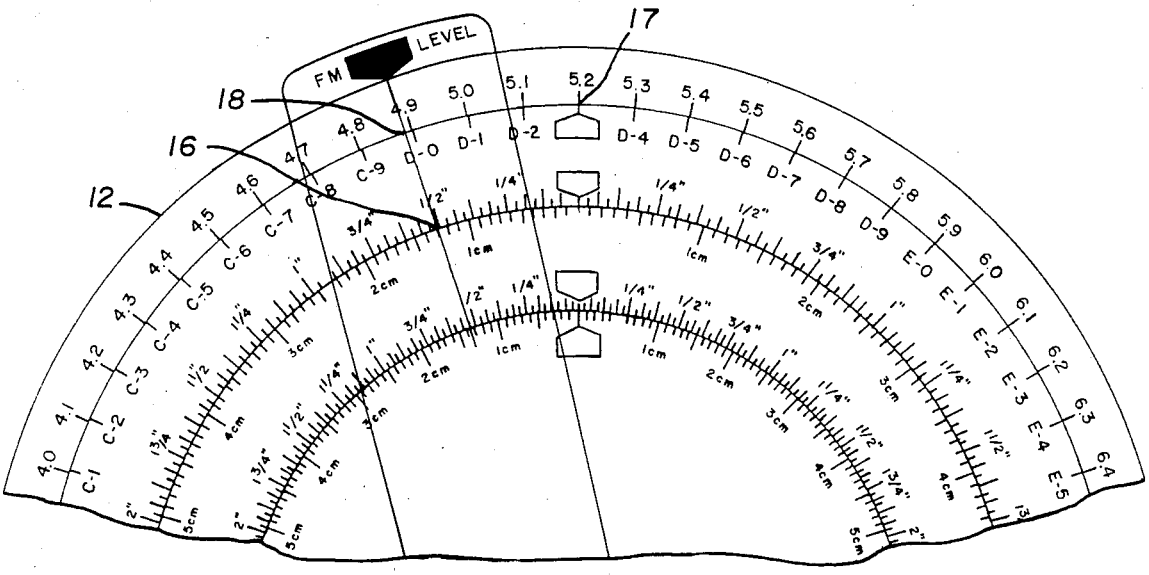
FIG. 3 shows a rotation, analagous to FIG. 2, to compensate for variation from the reference club length.
Figure 4:
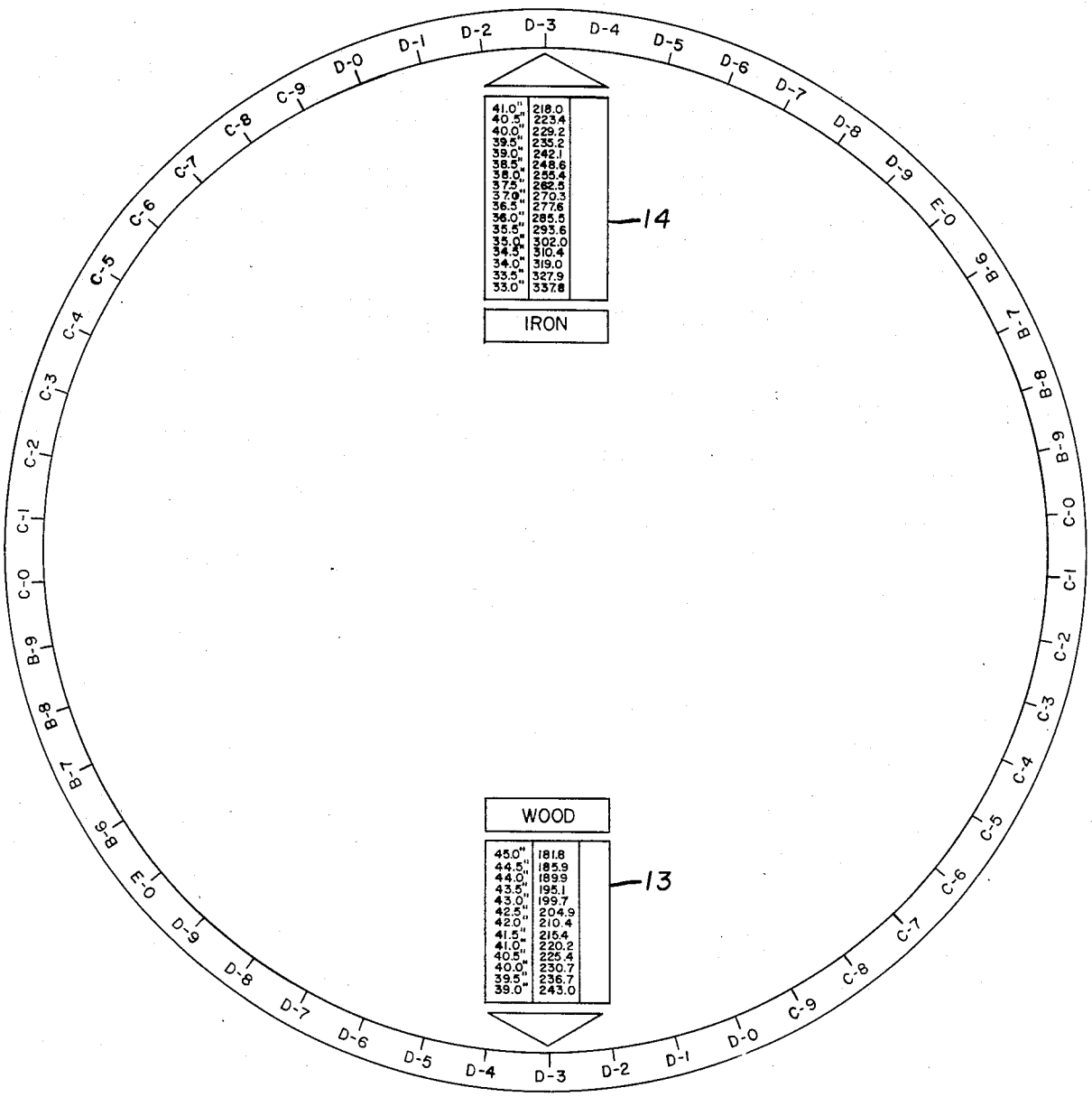
FIG. 4 shows the opposite face of the circular slide rule—such face utilized to calculate requisite head weight as a function of shaft length and desired swing weight.

However, if the same individual, i.e., for whom a flexibility index of 5.5 was found to be optimum, desired a set of irons and woods based on a swing weight, club length, hosel length, or tip insertion depth different from the reference club, the flexibility index (frequency level) of the shafts employed in producing his matched set of golf clubs would require compensation in order to provide the same "feel" that would be manifested by the reference shafts. Referring first to FIG. 2, the requisite compensation would be determined utilizing Sector 12, wherein the swing weight pointer on the "B" scale (at the D-3 reference) would be set, as shown at 15, under the prescribed frequency level 5.5 of the "A" scale, such that the compensated frequency level on the "A" scale would be opposite, as shown by cursor line 16, the desired D-0 swing weight on the "B" scale. As shown in FIG. 2, the compensated frequency level would be 5.2, in this instance. Thereafter, club length compensation is determined, referring to FIG. 3, by moving the swing weight pointer under the newly determined frequency level, shown at 17, (compensated to 5.2 for the desired D-0 swing weight), and holding the "B" scale annular portion in position while moving the cursor line 16 to the desired one-half inch over club length on the "C" scale, whereby the additionally compensated frequency level on the "A" scale will now read 4.88, as shown at 18. This process would then be repeated, if necessary, utilizing the "D" scale and "E" scale to compensate for differences in hosel length and tip insertion depth, respectively, from the reference length and depth, employed in the empirical determination of optimum flexibility index. Once such compensations are determined, requisite head weights would then be determined by referring to the reverse face and rotating the iron and wood pointers to the desired D-0 swing weight (not shown, but analogous to that of FIG. 4). Since head weights shown in FIG. 4 are independent of the flexibility index compensations determined on the front face of the calculator, the former figures could be provided separately, e.g., in a table or in a different slide rule. It is seen, however, in the preferred embodiment, that the requisite calculations and correlations necessary to determine shaft flexibility and head weight as a function of an individual's driving capability and desired swing weight, club length, hosel length, and tip insertion depth can all be set forth in one integral slide rule—providing the golf club maker with an inexpensive, accurate, and easy-to-use calculator for determining the optimum set of shafts to employ which will provide the individual golfer with a matched set of clubs exhibiting a "feel", tailored specifically to that individual.

What is claimed:

1. A special purpose slide rule useful in the determination of an optimum degree of shaft flexibility for a set of golf clubs and for calculating the degree of shaft flexibility required to compensate for an individual's preferences in swing weight and club length, said slide rule comprising:

a base element having a scale marked with flexibility indicia of the golf shafts to be employed in the production of the golf clubs in which said flexibility indicia are a function of the vibration frequency of the shafts; and one or more elements moveable with respect to the base scale, said one or more elements having scales thereon, each scale being marked with indicia of a golf club variable, the variables comprising (a) golf club swing weight, (b) golf club length, (c) hosel length, and (d) tip insertion depth, the markings on each of the scales, on said moveable elements including, respectively, (i) a set point based on the reference swing weight, club length, hosel length, and tip insertion depth, utilized in determining the flexibility indicia marked on the fixed scale, and (ii) indicia for swing weights, club lengths, hosel lengths, and tip insertion depths above and below the respective set point swing weight, set point club length, set point hosel length, and set point tip insertion depth, whereby the degree of shaft flexibility compensation is determined by placing a set point for the golf club variable in question in alignment with an initial flexibility index, such that the compensated flexibility index would be in alignment with the variable desired.

2. The slide rule of claim 1, in which the flexibility index is proportional to the driving capability of the individual.

3. The slide rule of claim 2, including a cursor moveable with respect to the fixed and moveable scales.

4. A special purpose circular slide rule useful in the determination of an optimum degree of shaft flexibility for a set of golf clubs and for calculating the degree of shaft flexibility required to compensate for an individual's preferences in swing weight and club length, said slide rule consisting of a plurality of concentric discs mounted for relative rotation with respect to each other about a common axis, comprising:

a base disc marked with flexibility indicia of the golf shafts to be employed in the production of the golf clubs in which said flexibility indicia are a function of the vibration frequency of the shafts; and one or more discs moveable with respect to the base disc, said one or more discs having scales thereon, each scale being marked with indicia of a golf club variable, the variables comprising: (a) golf club swing weight; (b) golf club length; (c) hosel length; and (d) tip insertion depth; the markings on each of the scales, on said moveable discs, including, respectively, (i) a set point based on the reference swing weight, club length, hosel length, and tip insertion depth, utilized in determining the flexibility indicia marked on the base disc, and (ii) indicia for swing weights, club lengths, hosel lengths, and tip insertion depths above and below the respective set point swing weight, set point club length, set point hosel length, and set point tip insertion depth, whereby the degree of shaft flexibility compensation is determined by placing a set point for the golf club variable in question in radial alignment with an initial flexibility index, such that the compensated flexibility index would lie on the same radial line as the variable desired.

5. The slide rule of claim 4, in which the base scale marked with flexibility indicia is the outermost annular portion of the circular slide rule, and the moveable disc or discs are of smaller diameter than the base disc.

6. The slide rule of claim 5, having a second base scale marked with indicia correlated with the swing weights to which the golf clubs will be supplied, and correlated with each such swing weight, a series of head weights corresponding to shafts of different lengths, to be employed in the production of said set.

7. The slide rule of claim 6, in which the flexibility index utilized is proportional to the driving capability of the individual.

8. The slide rule of claim 7, including a cursor mounted for relative motion about said common axis.

9. The slide rule of claim 5, in which said moveable scales are all set forth on one disc.

10. The slide rule of claim 6, in which such head weights are set forth on the same disc as said indicia of swing weights.

* * * * *